US007093522B2

(12) United States Patent
Guy et al.

(10) Patent No.: US 7,093,522 B2
(45) Date of Patent: Aug. 22, 2006

(54) TORQUE INDICATING WRENCH

(75) Inventors: Hanoch Guy, Petach Tikva (IL); Yehoshua Weinstein, Haifa (IL)

(73) Assignee: E.T.M. Precision Tool Manufacture Ltd., Tefen (IL)

( * ) Notice: Subject to any disclaimer, the term of this patent is extended or adjusted under 35 U.S.C. 154(b) by 53 days.

(21) Appl. No.: 10/943,993

(22) Filed: Sep. 20, 2004

(65) Prior Publication Data

US 2005/0109172 A1 May 26, 2005

(30) Foreign Application Priority Data

Nov. 24, 2003 (IL) ..... 159027

(51) Int. Cl.
*B25B 23/144* (2006.01)

(52) U.S. Cl. ..... 81/479; 81/477; 81/480

(58) Field of Classification Search ..... 81/467, 81/478, 479

See application file for complete search history.

(56) References Cited

U.S. PATENT DOCUMENTS

| | | | | | |
|---|---|---|---|---|---|
| 2,250,941 | A | | 7/1941 | Zimmerman | |
| 3,076,362 | A | * | 2/1963 | Able | 81/478 |
| 3,485,117 | A | * | 12/1969 | Tyrrell et al. | 81/477 |
| 3,967,513 | A | | 7/1976 | Myrdal | |
| 4,215,599 | A | * | 8/1980 | Batchelder et al. | 81/467 |
| 4,244,434 | A | | 1/1981 | Wilson | |
| 4,314,490 | A | | 2/1982 | Stone | |
| 4,535,659 | A | | 8/1985 | Yang | |
| 4,664,001 | A | * | 5/1987 | Denman | 81/479 |
| 4,938,109 | A | * | 7/1990 | Torres et al. | 81/467 |
| 4,958,541 | A | | 9/1990 | Annis et al. | |
| 5,130,700 | A | | 7/1992 | Annis et al. | |
| 5,172,616 | A | | 12/1992 | Negishi | |
| 5,737,983 | A | * | 4/1998 | Rennerfelt | 81/479 |
| 5,911,154 | A | * | 6/1999 | Hsieh | 73/1.12 |
| 6,070,506 | A | * | 6/2000 | Becker | 81/479 |
| 6,314,846 | B1 | * | 11/2001 | Winick | 81/477 |
| 6,523,442 | B1 | * | 2/2003 | Lehnert et al. | 81/467 |
| 6,752,050 | B1 | * | 6/2004 | Hu | 81/467 |
| 6,766,717 | B1 | * | 7/2004 | Hu | 81/467 |
| 2002/0069730 | A1 | * | 6/2002 | Lehnert et al. | 81/467 |
| 2003/0079578 | A1 | * | 5/2003 | Hu | 81/467 |
| 2003/0221524 | A1 | * | 12/2003 | Hu | 81/467 |

* cited by examiner

*Primary Examiner*—David B. Thomas
*Assistant Examiner*—Robert Scruggs
(74) *Attorney, Agent, or Firm*—Womble Carlyle

(57) ABSTRACT

A wrench comprises a casing and a rod. The rod has a driven portion, a driving tip, and a straight section which extends therebetween. The driven portion has a clamped section, a rotating section and a cantilever section connected therebetween, the clamped section being securely clamped in the casing. The rotating section being rotatable, between a free position and a biased position, wherein in the biased position the rod closes an electric circuit, thereby activating an indicator.

20 Claims, 8 Drawing Sheets

TORQUE INDICATING WRENCH

FIELD OF THE INVENTION

The present invention relates to a torque wrench which produces an indication when a predetermined torque is reached.

BACKGROUND OF THE INVENTION

Torque wrenches are used to apply a controlled amount of torque to a threaded fastener. Torque wrenches which produce an indication when a pre-determined torque is reached are disclosed in, for example, U.S. Pat. No. 2,250,941 to Zimmerman, U.S. Pat. No. 3,967,513 to Myrdal, U.S. Pat. No. 4,244,434 to Wilson, U.S. Pat. No. 4,314,490 to Stone, U.S. Pat. No. 4,535,659 To Yang, U.S. Pat. No. 4,664,001 to Denman, U.S. Pat. No. 4,958,541 to Annis et al., U.S. Pat. No. 5,130,700 to Annis et al., U.S. Pat. No. 5,172,616 to Negishi and U.S. Pat. No. 6,070,506 to Becker.

U.S. Patent application Publication No. 2003/0079578A1 to Hu discloses a simplified wrench having an engaging member, mounted in a casing, and biased to press against a first section of a substantially L-shaped rod, a second section of the L-shaped rod being a driving section with means for engaging a fastener. As the engaging member presses the first section of the rod, it exerts an engaging force between the first section of the rod and the engaging member. When a rotational force applied to the casing is greater than the engaging force, the casing slides, while the rod is not turned. Such mechanisms are known as "break-away" mechanisms.

The wrench described above is purely mechanical. Indication that a pre-determined torque limit is reached is achieved by a sudden, mechanical release ("break-away") of the torque applied to the fastener. Additionally, the wrench requires three precision mechanical parts, the first section of the rod, a spring, and a ball. Adjustment of the torque limit, or the "break-away" point, requires dismantling the apparatus and changing a component, i.e., the spring.

SUMMARY OF THE INVENTION

In accordance with the present invention, there is provided a wrench comprising a casing and a rod, the rod having a driven portion, a driving tip, and a straight section therebetween, the driven portion having a clamped section, a rotating section and a cantilever section therebetween, the clamped section being securely clamped in the casing, the rotating section being rotatable, between a free position and a biased position, wherein in the biased position the rod closes an electric circuit, thereby activating an indicator.

Preferably, the casing comprises a base and a cover secured together.

Further preferably, in the free position the rotating section of the rod nests in a base channel in the base, substantially below a base inner face.

Yet further preferably, in the biased position at least a portion of the rotating section of the rod is located above the base inner face in a rotation relief channel in a cover inner face.

In accordance with the present invention, the driven portion is substantially U-shaped, the cantilever section is substantially parallel to the straight section of the rod, and the clamped section and the rotating section are substantially perpendicular to the cantilever section extending therebetween.

In accordance with the present invention, the electric circuit comprises a battery housed in the casing, the rod, and a terminal connected to the battery.

Preferably, the electrical circuit closes when the rod is in the biased position by a contact formed between the rod and the terminal.

In accordance with the present invention, the biased position is externally adjustable by an adjusting bolt threading into a threaded adjusting bore and bearing against the terminal. The adjusting bolt is operatively connected to the terminal and configured to adjust an amount of torque required to activate the indicator.

In accordance with the present invention, the indicator can be a light source, typically a Light Emitting Diode (LED) or an audio source such as a buzzer.

In another aspect, the present invention is directed to a wrench including a casing, a rod at least partially housed in the casing and a battery-powered indicator The rod has a driven portion connected to a driving tip, the driven portion including a clamped section clamped in the casing, and a rotating section connected to clamped section. The rotating section is movable between a free position, and a biased position in which the rotating section closes an electric circuit to thereby activate the indicator.

BRIEF DESCRIPTION OF THE DRAWINGS

For a better understanding of the present invention and to show how the same may be carried out in practice, reference will now be made to the accompanying drawings, in which.

Figure 1:
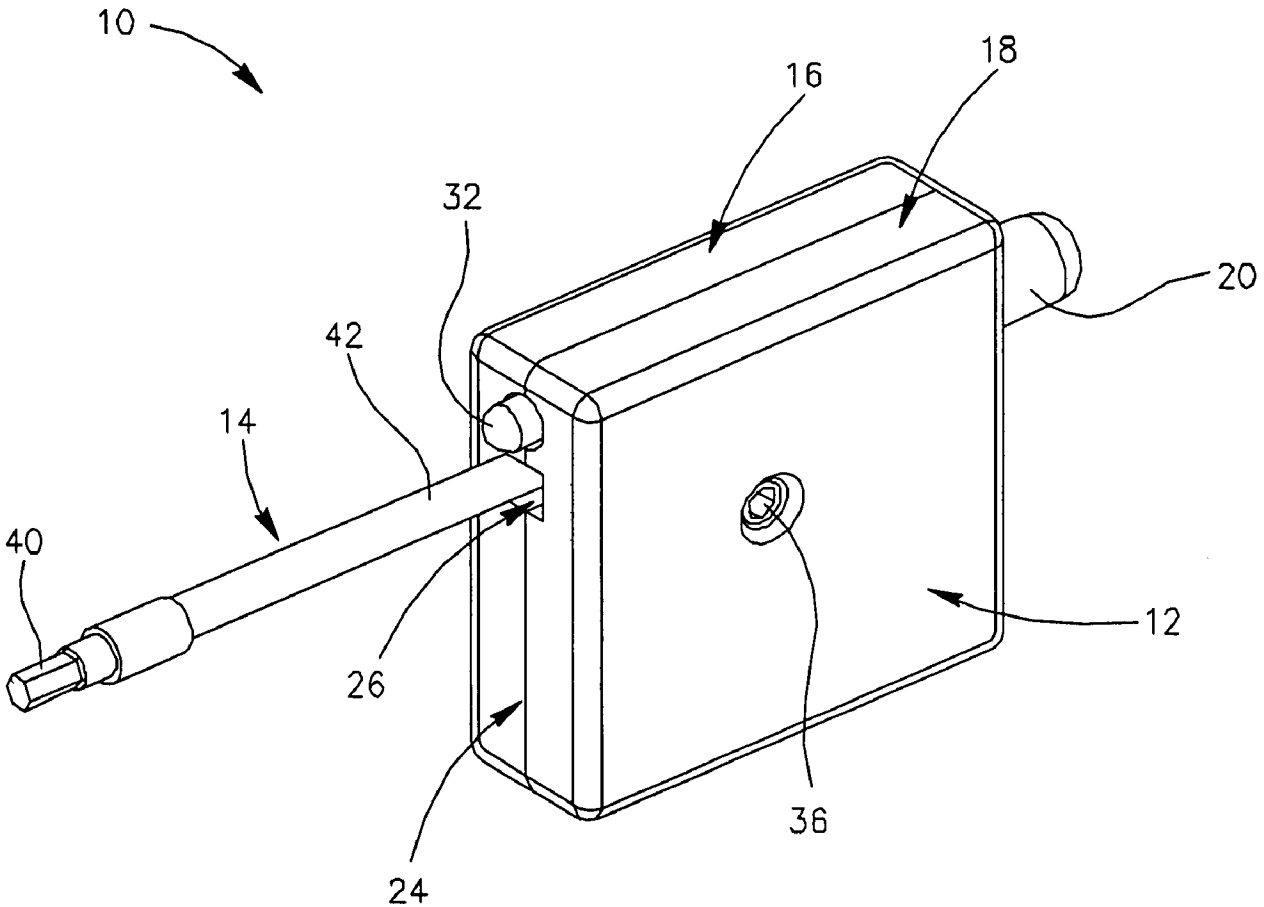
FIG. 1 is a perspective view of a wrench in accordance with the present invention.
Figure 2:
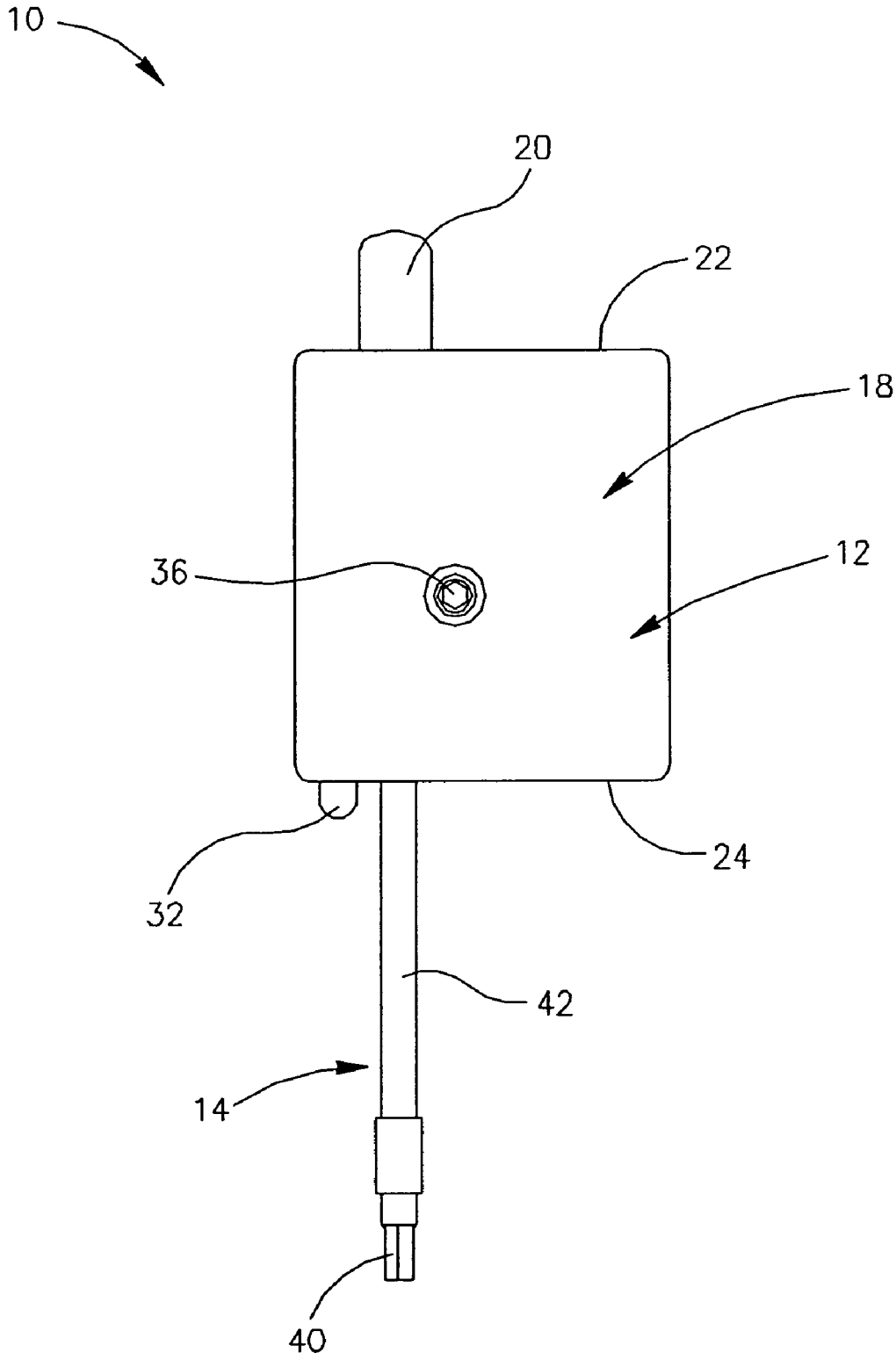
FIG. 2 is a side face view of the wrench shown in FIG. 1.
Figure 3:
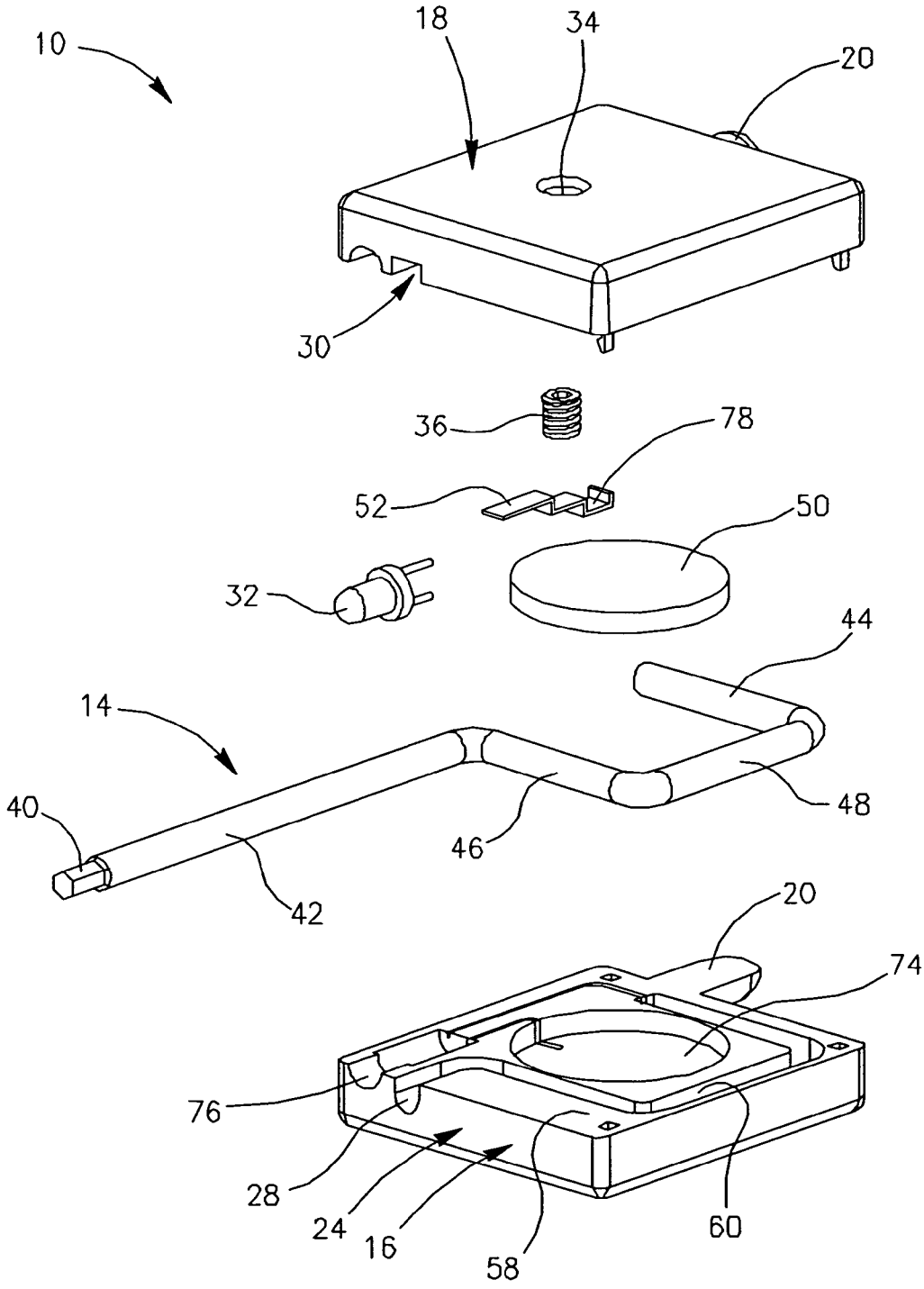
FIG. 3 is an exploded perspective view of the wrench shown in FIG. 1.

Attention is drawn to FIGS. 1 to 3, showing a wrench 10 in accordance with a preferred embodiment of the present invention. The wrench 10 comprises a casing 12 and a rod 14. A portion of the rod 14 can be rotated relative to the casing 12 between a free position and a biased position, as will be further explained below. The casing 12 is of a generally rectangular shape, comprising a base 16 secured to a cover 18. A cylindrical protrusion 20 extends from a top face 22 of the casing.

The rod 14 emerges from a bottom face 24 of the casing 12 through an elongated rod aperture 26, having a base aperture section 28 which extends into the base 16 and a cover aperture section 30 extending into the cover 18. An indicator 32 is disposed in the bottom face 24, and protrudes from the casing 12. The indicator may be a light source such as a Light Emitting Diode (LED) or an audio source, such as a buzzer. A threaded adjusting bore 34 extends through the cover 18 and accommodates an adjusting bolt 36.

Figure 4:
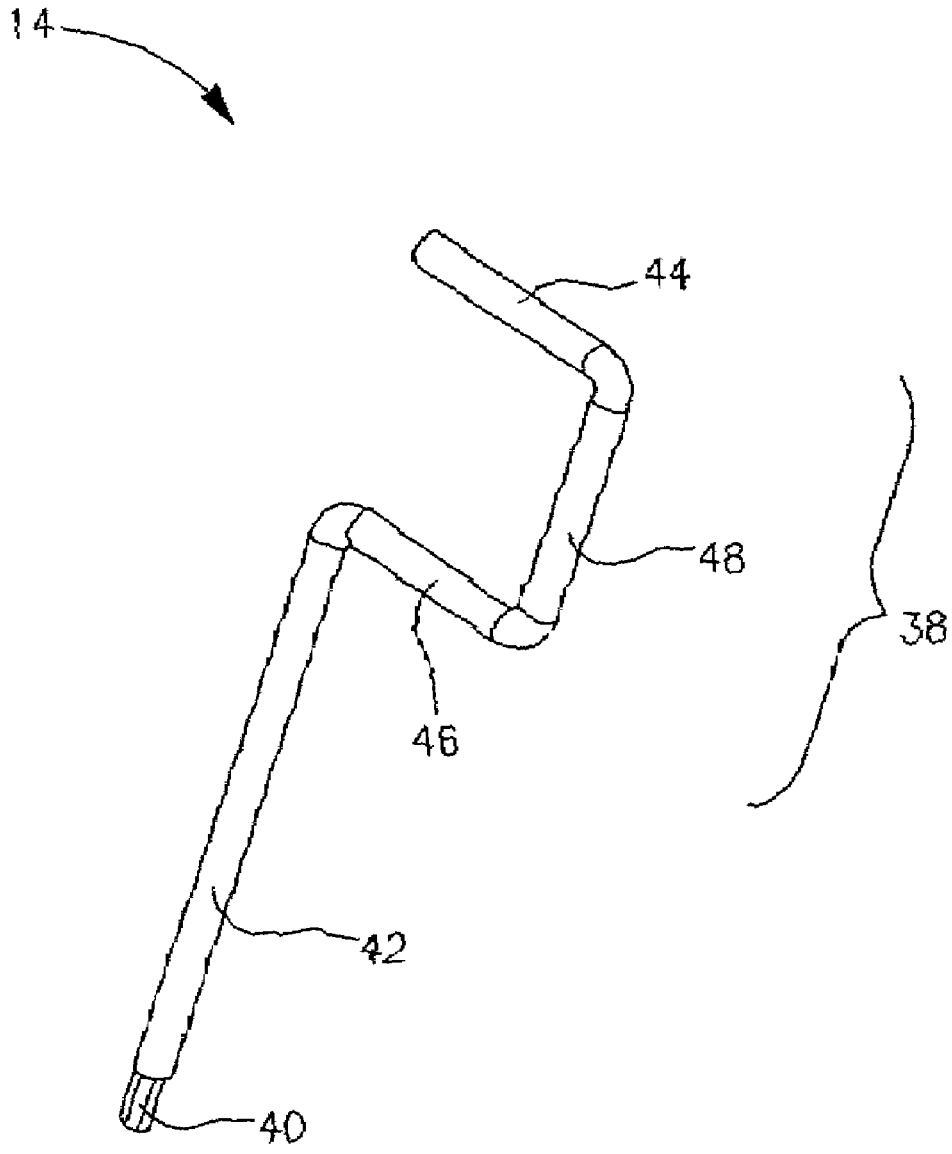
FIG. 4 is a perspective view of the rod shown in FIGS. 1 to 3.

As shown in FIGS. 3 and 4, the rod 14 comprises a driven portion 38 and a driving tip 40, with a straight section 42 extending therebetween. The driven portion 38, having a general U-shape, comprises a clamped section 44, a rotating section 46 generally parallel thereto, and a cantilever section 48 disposed therebetween, the cantilever section 48 being generally perpendicular both to the clamped section 44 and the rotating section 46, and parallel to the straight section 42 of the rod 14.

The indicator 32 forms a part of an electric circuit, comprising a battery 50, a battery terminal 52, a battery lead 54 and a rod lead 56. Both the rod lead 56 and the battery lead 54 are disposed in a base inner face 58. The rod lead 56 connects the indicator 32 to the rod 14 which, being made of metal, forms a part of the electric circuit. The battery lead 54 connects the indicator 32 to a first pole, while the battery terminal 52 contacts a second pole of the battery 50.

The rod 14 is accommodated in the base 16, in a generally U-shaped base channel 60, disposed in the base inner face 58, the base channel 60 terminating in the base aperture section 28. The base channel 60 has a base channel depth which is approximately equal to a diameter of the rod 14.

Figure 5:
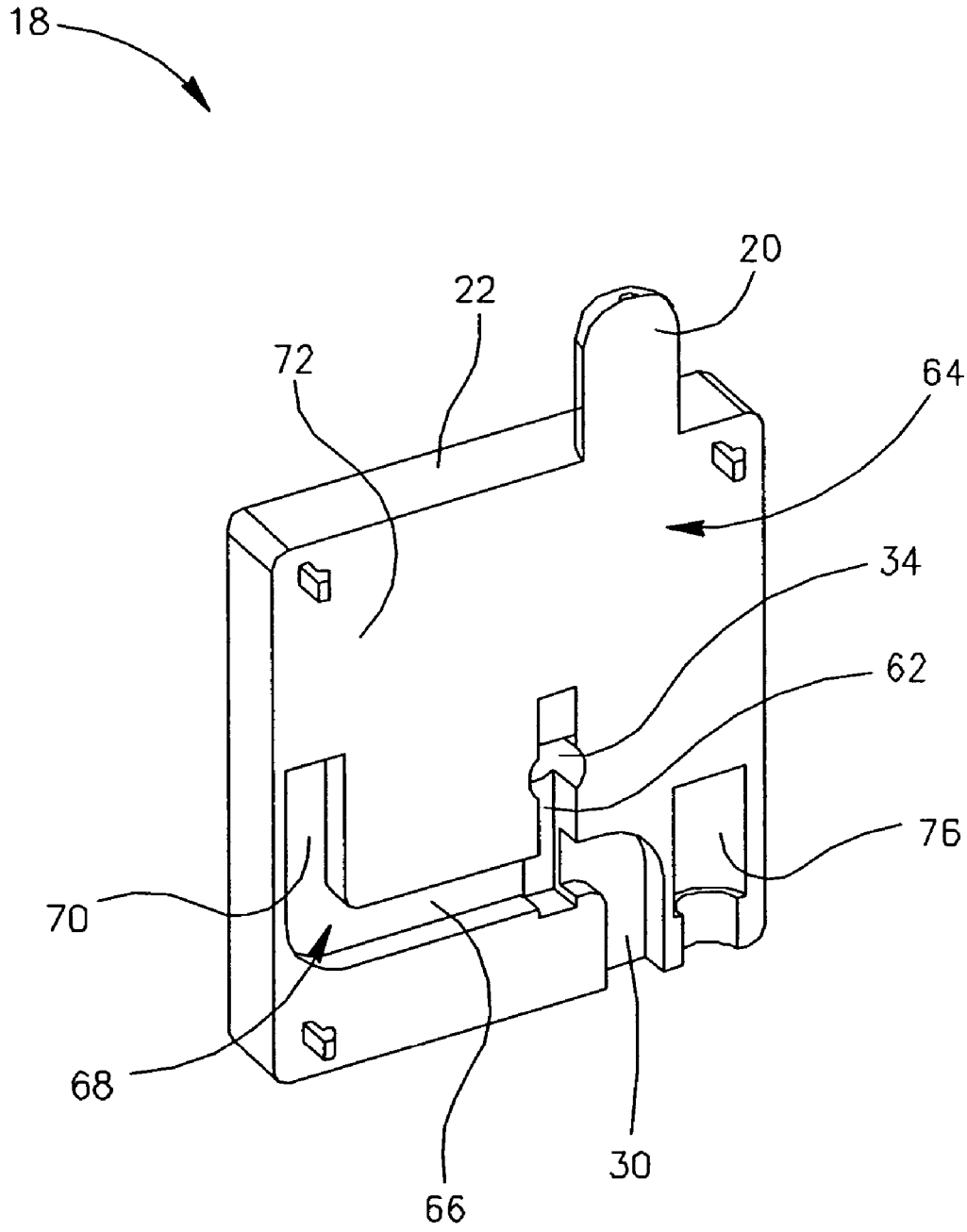
FIG. 5 is a perspective view of a cover of the wrench shown in FIG. 3.
Figure 6:
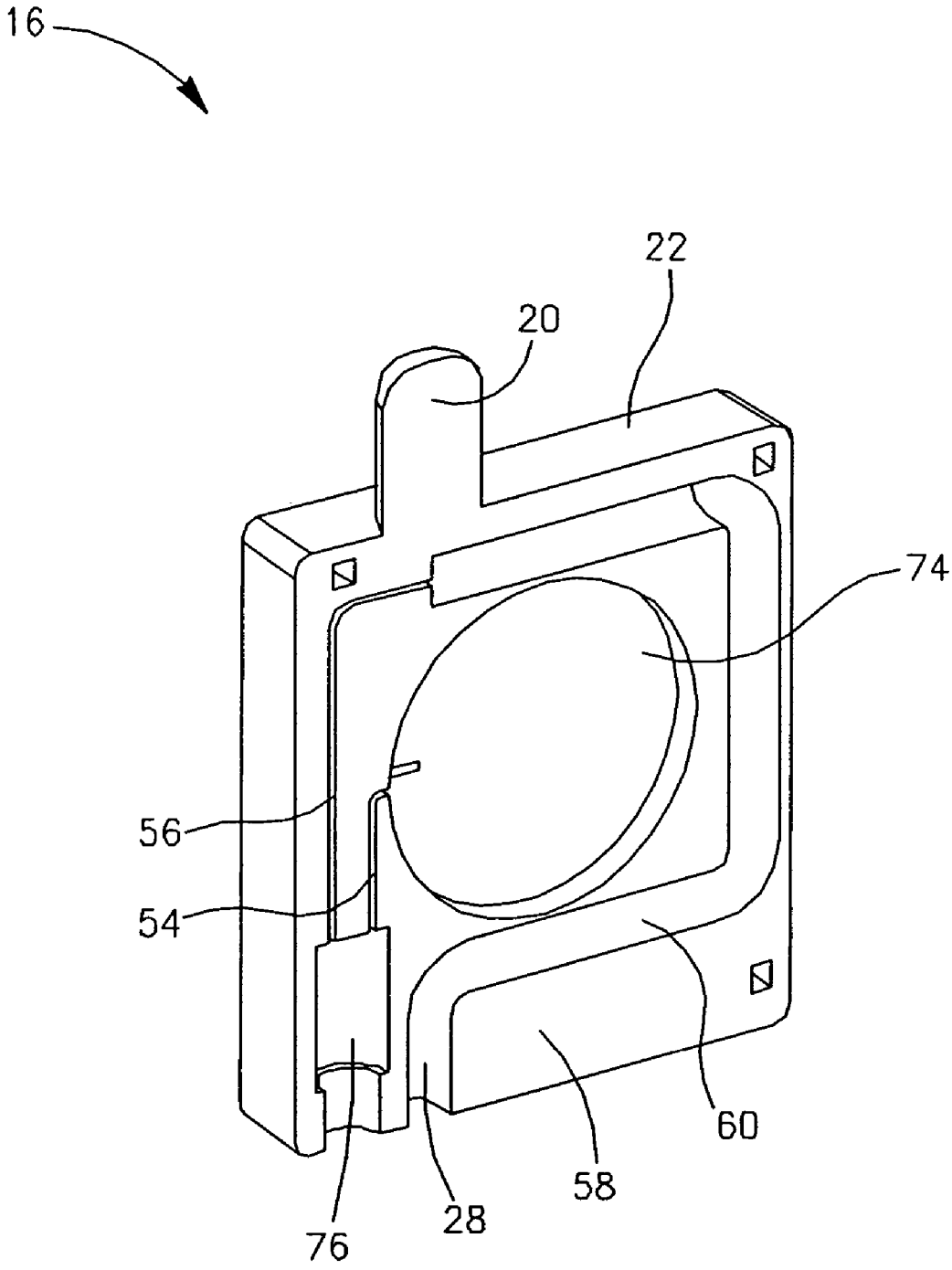
FIG. 6 is a perspective view of a base of the wrench shown in FIG. 3.

As shown in FIG. 5, a terminal channel 62, is formed in a cover inner face 64 and meets the threaded adjusting bore 34. The cover aperture section 30 is disposed in the cover inner face 64, and extends into a rotation relief section 66 of a generally S-shaped cover relief channel 68, the rotation relief section 66 being generally parallel to the bottom face 24 of the casing 12. The rotation relief section 66 merges with a cantilever relief section 70 extending perpendicularly thereto. The cover relief channel 68 has a cover relief channel depth which is approximately equal to the diameter of the rod 14. The cantilever relief section 70 terminates in a flat clamping portion 72 of the cover inner face 64, adjacent the top face 22 of the casing 12.

When the wrench 10 is assembled, the rod 14 is accommodated in the base channel 60. Since the base channel depth is approximately equal to the diameter D of the rod 14, the rod 14 does not protrude much above the base inner face 58. The battery 50 is accommodated in a battery well 74, and the indicator 32 is located in an indicator receptacle 76. The adjusting bolt 36 is threaded into the threaded adjusting bore 34, and the battery terminal 52 is located in the terminal channel 60 in the cover inner face 64. The cover 18 is secured to the base 16, so that the base inner face 58 and the cover inner face 64 abut, and the clamped section 44 of the rod 14 is secured in the base channel 60 by the flat clamping portion 72 of the cover inner face 64. The adjusting bolt 36 urges the battery terminal 52 away from the terminal channel 60, so that a first terminal section 78 contacts one of the poles of the battery 50.

Figure 7:
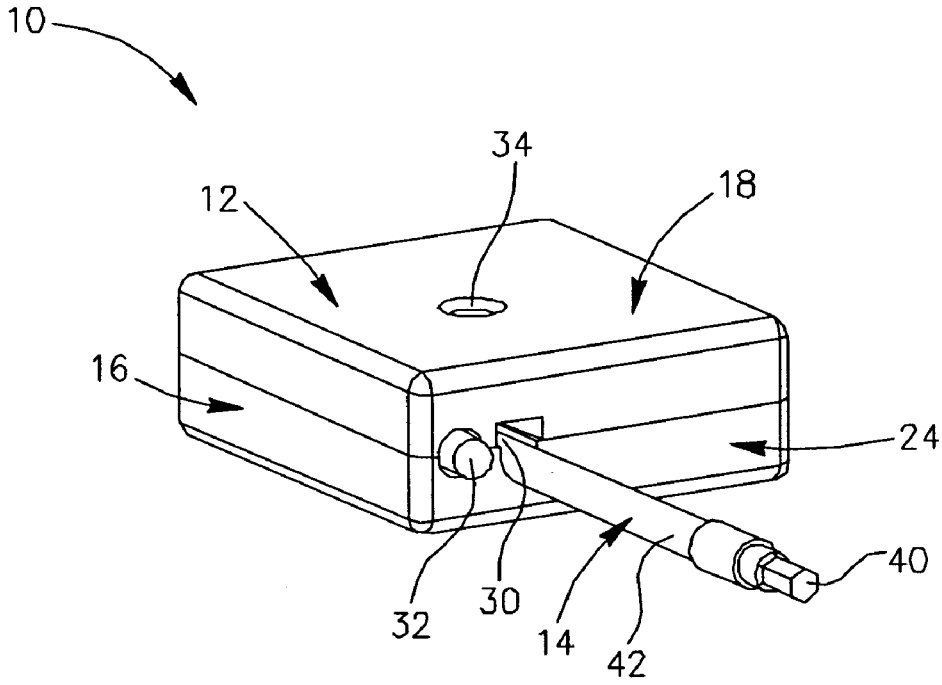
FIG. 7 is a perspective view of the wrench, showing the rod in a free position.
Figure 8:
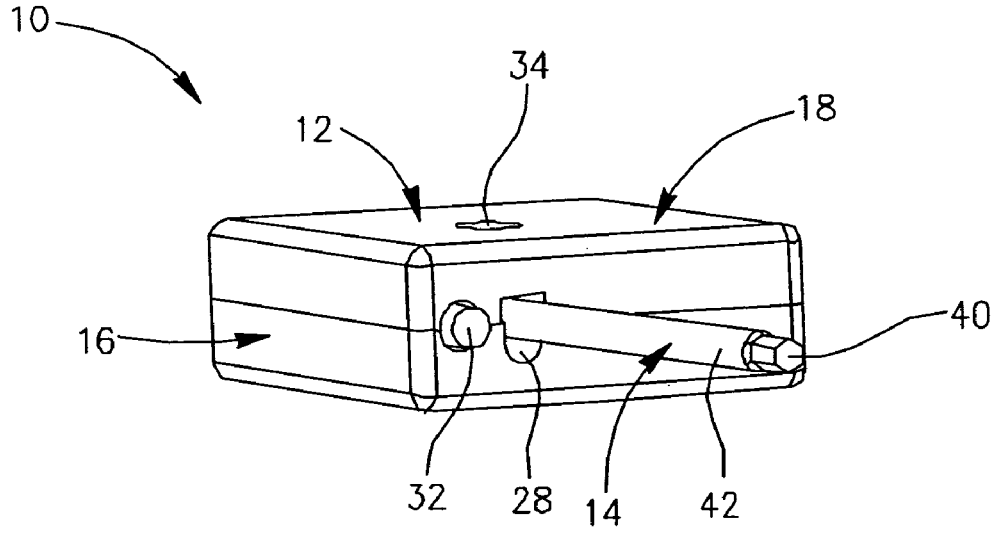
FIG. 8 is a perspective view of the wrench, showing the rod in a biased position.

FIGS. 7 and 8 show the assembled wrench 10 in the two extreme positions of the rotation of the rod 14 relative to the casing 12. FIG. 7 shows the rod 14 in its free position, in which the straight section 42 the rod 14 emerges from the base aperture section 28 of the base 16. FIG. 8 shows the rod 14 in the biased position, in which the straight section 42 of the rod 14 emerges from the cover aperture section 30 of the cover 18.

With no torque applied to the wrench 10, the rod 14 is in the free position, with the driven portion 38 of the rod 14 nesting in the base 16 of the casing 12. The electrical circuit remains open as long as the rod 14 and the battery terminal 52 do not touch. Therefore, in the free position, the electrical circuit remains open and the indicator 32 is not activated.

Figure 9:
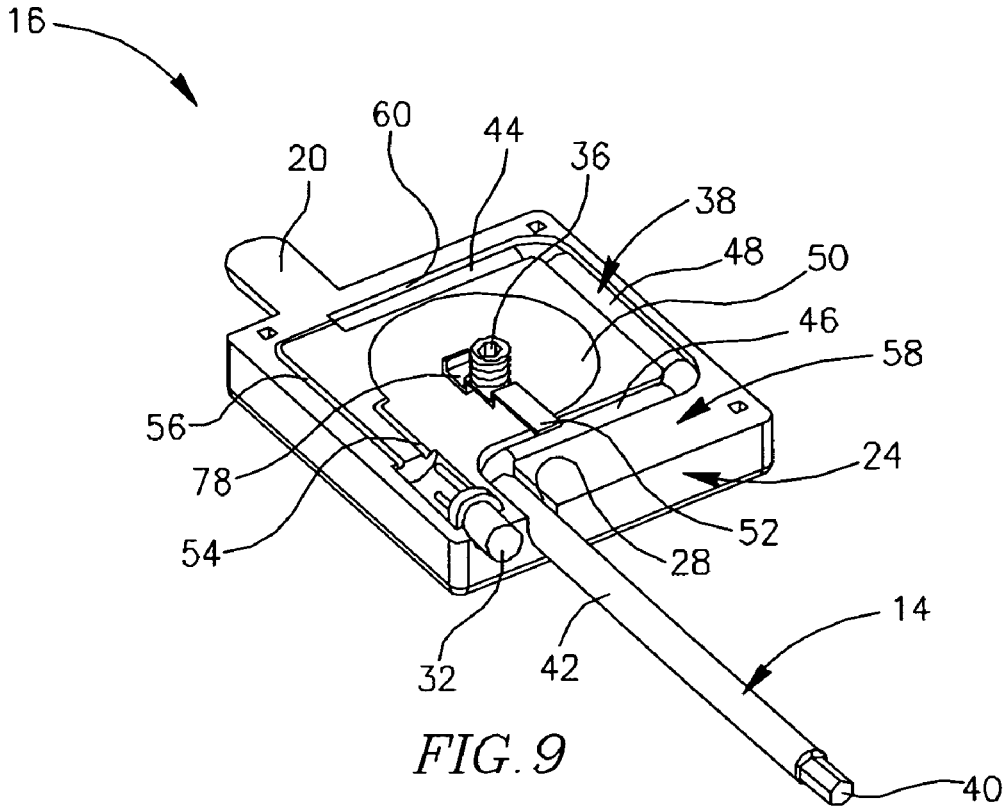
FIG. 9 is the perspective view of the wrench shown in FIG. 7, with the cover removed.
Figure 10:
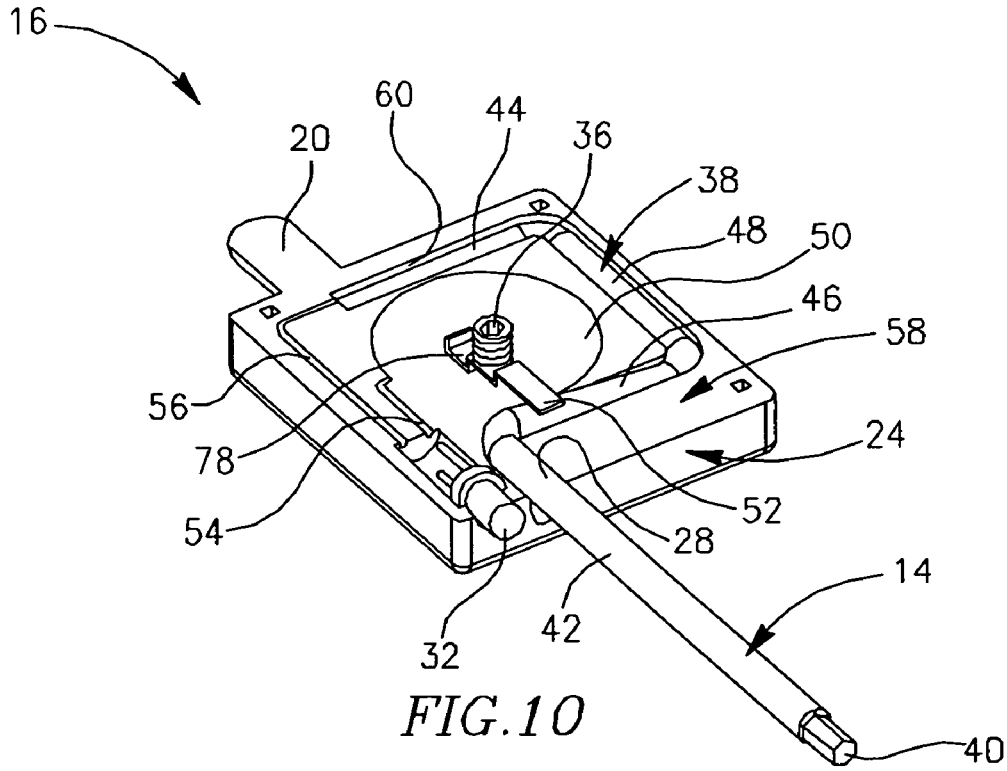
FIG. 10 is the perspective view of the base of the wrench shown in FIG. 8, with the cover removed.

Reference is now made to FIGS. 9 and 10. When using the torque wrench 10, the driving tip 40 is inserted into a fastener (not shown), and torque is applied to the casing 12, which bears on the clamped section 44 of the rod 14, causing the clamped section 44, and thus the entire rod 14, to rotate, and tighten the fastener. As the torque applied to the casing 12 is increased, the torque applied to the clamped section 44 of the rod 14 is correspondingly increased, and the rotating section 46 resiliently twists the cantilever section 48, so that the rotating section 46 shifts angularly relative to the clamped section 44. A portion of the rotating section 46 distal the cantilever section 48 is urged away from, and out of, the base channel 60, to above the base inner face 58, and into the rotation relief section 66 in the cover 18, and the rod moves from the free position towards the biased position. The angular shift of the rotating section 46 continues to increase, as the applied torque is increased, until at a given torque the biased position of the rod 14 is reached and contact is made between the rotating section 46 of the rod 14, and the battery terminal 52, causing the electric circuit to close. Consequently, the indicator 32 is activated, indicating that the biased position, and therefore, the pre-determined torque, has been reached.

The pre-determined torque required to rotate the rod 14 into contact with the battery terminal 52 in the biased position can be adjusted using the adjusting bolt 36. Turning the adjusting bolt 36 clockwise causes it to advance into the threaded adjusting bore 34, urging the battery terminal 52 away from the cover inner face 64 and towards the rotating section 46 of the rod 14, thus reducing the amount of twist needed for the rod 14 to contact the battery terminal 52. Turning the adjusting bolt 36 anti-clockwise urges the battery terminal 52 away from the rotating section 46 of the rod 14, increasing the amount of twist required to move the rod 14 into contact with the battery terminal 52, therefore increasing the torque required to activate the indicator 32. Thus, the adjusting bolt 36 adjusts the amount of torque required to activate the indicator.

Although the present invention has been described to a certain degree of particularity, it should be understood that various alterations and modifications could be made without departing from the scope of the invention as hereinafter claimed.

The invention claimed is:

1. A wrench comprising a rod and a casing, the rod having a driven portion, a driving tip, and a straight section therebetween;

the driven portion having a clamped section, a rotating section and a cantilever section therebetween;

the clamped section being securely clamped in the casing;

the rotating section being rotatable between a free position and a biased position;

wherein in the biased position, the rod closes an electric circuit, activating an indicator; and wherein the rotating section is transverse to the straight section.

2. The wrench of claim 1, wherein the casing comprises a base and a cover secured together.

3. The wrench of claim 2, wherein in the free position the rotating section of the rod nests in a base channel in the base, substantially below a base inner face.

4. The wrench of claim 1, wherein the electric circuit includes a battery housed in the casing.

5. The wrench of claim 4, wherein the electric circuit comprises the rod and a terminal connected to the battery.

6. The wrench of claim 5, wherein the electrical circuit closes when the rod is in the biased position by a contact formed between the rod and the terminal.

7. The wrench of claim 6, further comprising an adjusting bolt threaded in an adjusting bore associated with the casing, the adjusting bolt operatively connected to the terminal and configured to adjust an amount of torque required to activate the indicator.

8. The wrench of claim 1, wherein the indicator is a Light Emitting Diode (LED).

9. The wrench of claim 1, wherein the indicator is a buzzer.

10. A wrench comprising a rod and a casing, the rod having a driven portion, a driving tip, and a straight section therebetween;

the driven portion having a clamped section, a rotating section and a cantilever section therebetween;

the clamped section being securely clamped in the casing;

the rotating section being rotatable between a free position and a biased position;

wherein in the biased position, the rod closes an electric circuit, activating an indicator;

wherein the casing comprises a base and a cover secured together;

wherein in the free position the rotating section of the rod nests in a base channel in the base, substantially below a base inner face; and wherein in the biased position at least a portion of the rotating section of the rod is located above the base inner face in a rotation relief channel in a cover inner face.

11. The wrench of claim 10, wherein the cantilever section is substantially parallel to the straight section of the rod.

12. A wrench comprising a rod and a casing, the rod having a driven portion, a driving tip, and a straight section therebetween;

the driven portion having a clamped section, a rotating section and a cantilever section therebetween;

the clamped section being securely clamped in the casing;

the rotating section being rotatable between a free position and a biased position;

wherein in the biased position, the rod closes an electric circuit, activating an indicator;

wherein the driven portion is substantially U-shaped.

13. The wrench of claim 12, wherein the clamped section and the rotating section are substantially perpendicular to the cantilever section extending therebetween.

14. A wrench comprising:

a casing;

a rod at least partially housed in the casing, the rod having a driven portion connected to a driving tip, the driven portion including a clamped section clamped in the casing, and a rotating section connected to the clamped section; and a battery-powered indicator;

wherein the rotating section is movable between a free position, and a biased position in which the rotating section closes an electric circuit to thereby activate the indicator; and wherein at least a portion of the rotating section is urged in a direction of a casing cover to close said electric circuit.

15. The wrench according to claim 14, wherein the driven portion further comprises a cantilever section connecting the clamped section to the rotating section.

16. The wrench according to claim 15, wherein the driven portion is substantially U-shaped with the clamped section and the rotating section being parallel to one another.

17. The wrench according to claim 16, wherein the rod further comprises a straight section connecting the driven portion to the driving tip.

18. The wrench according to claim 14, wherein said at least a portion of the rotating section is urged from a channel formed in a casing base into a channel formed in the casing cover, to close said electric circuit.

19. A wrench comprising:

a casing;

a rod at least partially housed in the casing, the rod having a driven portion connected to a driving tip, the driven portion including a clamped section clamped in the casing, and a rotating section connected to the clamped section; and a battery-powered indicator;

wherein the rotating section is movable between a free position, and a biased position in which the rotating section closes an electric circuit to thereby activate the indicator; and wherein:

the driven portion further comprises a cantilever section connecting the clamped section to the rotating section, the clamped section and the rotating section being substantially perpendicular to the cantilever section;

the rod further comprises a straight section connecting the driven portion to the driving tip; and the cantilever section is substantially parallel to the straight section of the rod.

20. A wrench comprising:

a casing;

a rod at least partially housed in the casing, the rod having a driven portion connected to a driving tip, the driven portion including a clamped section clamped in the casing, and a rotating section connected to the clamped section; and a battery-powered indicator;

wherein the rotating section is movable between a free position, and a biased position in which the rotating section closes an electric circuit to thereby activate the indicator; and further comprising an adjusting bolt threaded in an adjusting bore associated with the casing, the adjusting bolt configured to adjust an amount of torque required to activate the indicator.

* * * * *